United States Patent [19]

Spirito et al.

[11] Patent Number: 5,040,337

[45] Date of Patent: Aug. 20, 1991

[54] METHOD AND APPARATUS FOR HONING AIRCRAFT BLADES

[75] Inventors: Peter P. Spirito; Miller Haugh, both of Manchester, Conn.

[73] Assignee: Tool & Engineering, Div. of Wickes Companies, Inc., Manchester, Conn.

[21] Appl. No.: 444,047

[22] Filed: Nov. 30, 1989

[51] Int. Cl.[5] ..... B24B 7/00

[52] U.S. Cl. ..... 51/56 R; 51/122; 51/157; 51/217 S; 51/281 R

[58] Field of Search ..... 51/55, 56, 149, 156, 51/157, 158, 121, 122, 217 S, 281 R

[56] References Cited

U.S. PATENT DOCUMENTS

| | | | |
|---|---|---|---|
| 1,916,929 | 7/1933 | Lee | 51/156 X |
| 2,263,927 | 11/1941 | Malkovsky | 51/157 |
| 3,254,454 | 6/1966 | Cetrangolo | 51/56 |
| 3,557,493 | 1/1971 | Cuthbert et al. | 51/56 |
| 3,863,395 | 2/1975 | Brown | 51/121 |
| 4,060,939 | 12/1977 | Dubied et al. | 51/157 |
| 4,196,611 | 4/1980 | Suga | 51/157 X |
| 4,536,992 | 8/1985 | Hennenfent et al. | 51/121 X |

*Primary Examiner*—James G. Smith

*Attorney, Agent, or Firm*—Hoffmann & Baron

[57] ABSTRACT

An apparatus for honing workpieces such as the midspans of jet aircraft engine blades is provided. The apparatus includes a flexibly mounted honing stone which will seat itself on the flat surface of the workpiece to be treated. To provide the necessary flexibility, the honing stone is mounted to a support in such a manner that it is pivotable about at least two axes. It may also be moved in a direction which is substantially orthogonal to the two axes. This latter feature allows the stone to move downwardly as the surface of the work piece is honed. It also allows the honing stone to be moved entirely off the work piece and into a storage position. The apparatus further includes a support which is specifically designed for holding an aircraft blade in a position such that the wear surfaces of the midspans of such blades are in a substantially horizontal plane. Two clamping assemblies are provided for clamping the root and one of the midspans of a blade.

20 Claims, 5 Drawing Sheets

METHOD AND APPARATUS FOR HONING AIRCRAFT BLADES

BACKGROUND OF INVENTION

1. The field of the invention relates to honing machines.

2. Brief description of the prior art.

Blades for jet engines and the like typically include a root, a helically shaped airfoil extending from the root, and projections known as midspans extending substantially perpendicular from the airfoil. The midspans, also sometimes referred to as snubbers or clappers, support the airfoil when the engine is in operation. The blades are usually made from a titanium alloy. The roots are coated with a relatively soft material which functions as a gasket when the roots are mounted to a rotor. In contrast, the mating flat edges of the midspans which are exposed to wear are coated with a relatively hard coating. This hard, wear coating is relatively coarse until worn down through use.

In order to avoid the break-in period necessary for smoothing the coated wear surfaces of the midspans, grinding has been suggested as a possible treatment. Grinding, however is an expensive process which requires a high level of skill on the part of the operator. Since the blades are difficult to align, the grinding of each midspan would be a special job requiring individualized treatment. More importantly, grinding tends to produce microcracks which can propagate into the blade. Such cracks are very difficult to detect without specialized inspection methods.

SUMMARY OF THE INVENTION

It has been found that honing the wear surface of a midspan produces a surface which is sufficiently smooth that friction between the adjoining midspans of two blades can be minimized.

Honing is a process of removing a relatively small amount of material from a surface by means of an abrasive or diamond stone or the like. The finish which is obtained is dependent upon the grit of the stone which is used. In typical honing procedures, no more than a few thousandths of an inch of the treated surface is removed.

In accordance with the invention described herein, an assembly is provided for superfinishing a substantially flat surface. The superfinishing process employed may be described as a honing or lapping process. The assembly may include means for mounting an aircraft blade having at least one midspan, the midspan including a wear surface, means for moving a honing stone or the like into engagement with the wear surface, and means for oscillating the honing stone with respect to the wear surface.

In accordance with a preferred embodiment of the invention, an assembly is provided which includes a support, honing means mounted to said support, first pivot means for allowing said honing means to move about a first pivot axis, second pivot means for allowing said honing means to move about a second axis, means for mounting a workpiece, and means for oscillating said honing means with respect to said means for mounting a workpiece. The honing means is preferably rotated during such oscillation. The mounting means may include first clamping means for clamping the root of an aircraft blade and second clamping means for clamping a midspan of the aircraft blade. Means are also provided for flushing the honing means.

DETAILED DESCRIPTION OF THE INVENTION

Figure 1:
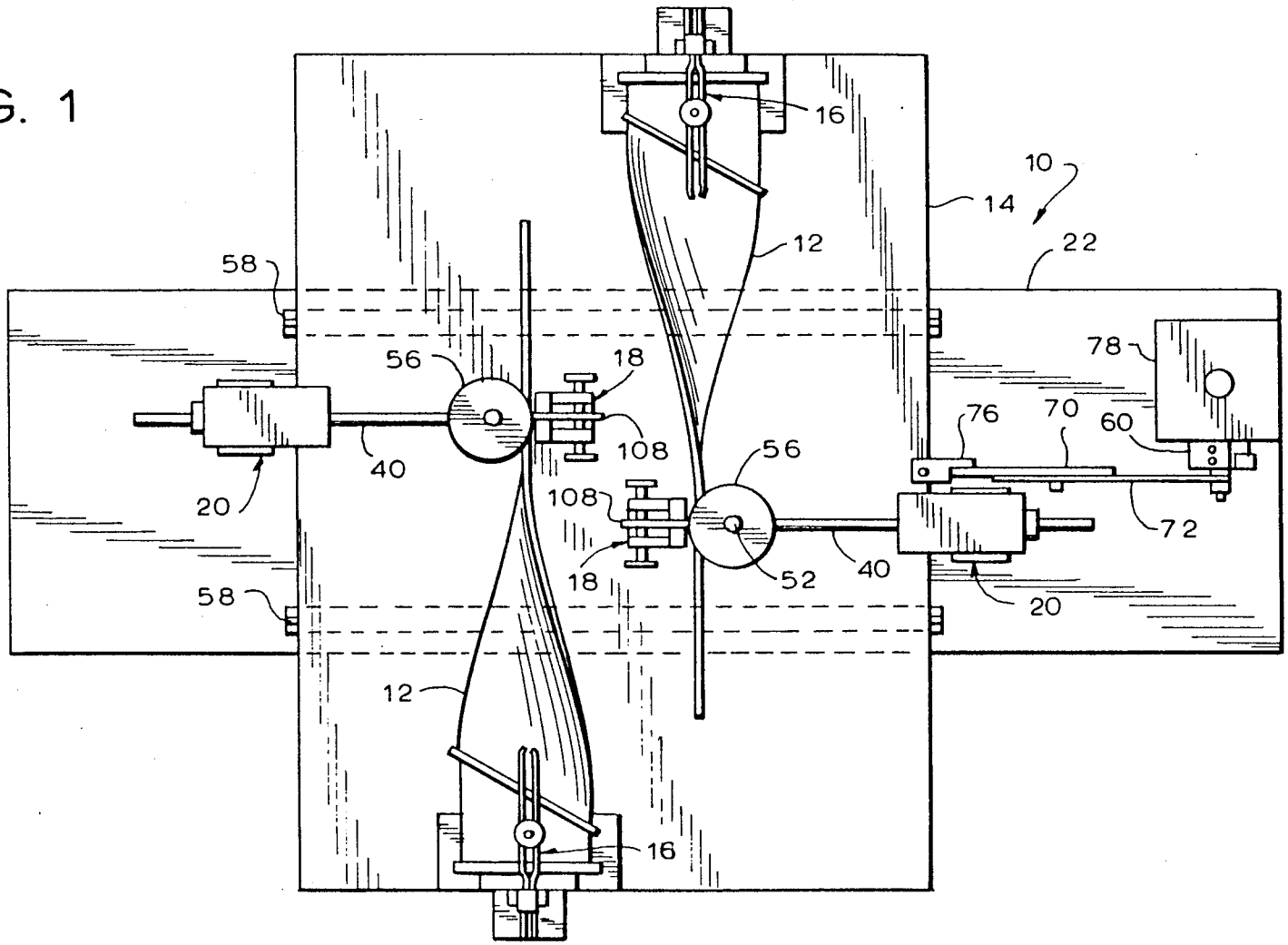
FIG. 1 is a top plan view of a honing assembly according to the invention.

An assembly 10 for honing the midspan of one or more aircraft blades 12 is shown in FIG. 1. The assembly includes a first mounting plate 14 to which a pair of specially designed clamping assemblies 16, 18 are secured. First and second supports 20 are mounted to a second mounting plate 22 positioned beneath the first mounting plate 14. A honing stone 24 is mounted to each of the supports 20 in a manner which allows it to make flat contact with the wear surface to be honed. Means are provided for oscillating the upper mounting plate 14 with respect to the lower mounting plate 22. The oscillating means include a motor 26 and a shaft assembly which allows the length of the stroke to be adjusted.

Figure 3:
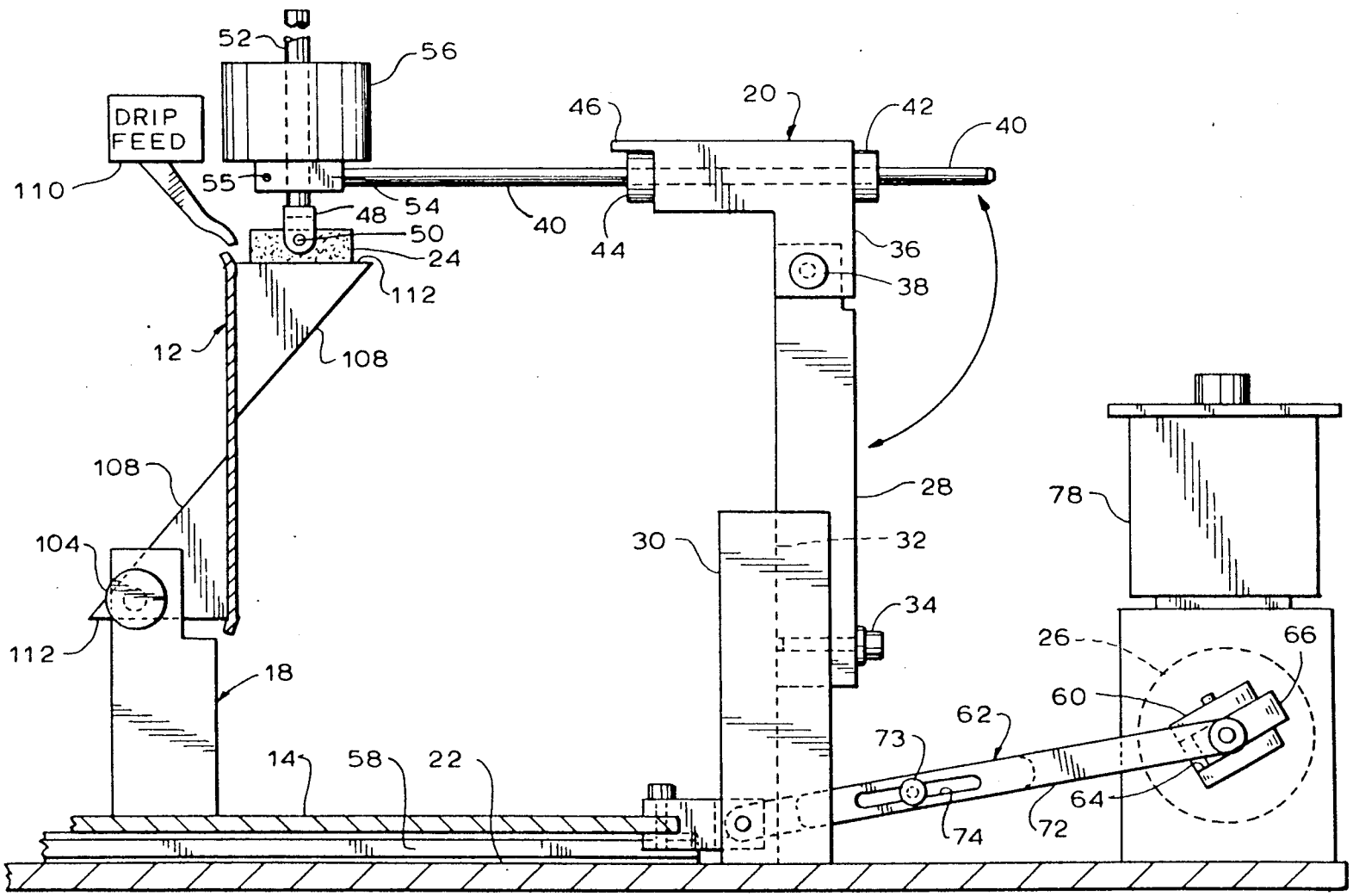
FIG. 3 is an enlarged, fragmentary front elevation view thereof.

Referring to FIG. 3, each support 20 includes a vertically projecting column 28 secured to a mounting block 30. Each mounting block 30 is secured to the lower mounting plate 22. Each column 28 may be raised or lowered by moving it in the appropriate direction within the slot 32 in the mounting block 30. A lock screw 34 is provided for securing the columns 28 with respect to each block 30.

An L-shaped block 36 is pivotably secured to the top of each column 28 by a pivot pin 38. The block 36 includes a bore through which a cylindrical shaft 40 extends. The shaft 40 is maintained in position by a pair of retaining rings 42, 44. One end of the block 36 includes a protruding lip 46. The retaining ring 44 adjoining this lip has a flattened or non-round surface where it adjoins the lip, and abuts the lip if the shaft 40 is rotated about its axis. The rotatability of the shaft 40 with respect to the block 36 is accordingly limited to between about five and twenty degrees.

Figure 6:
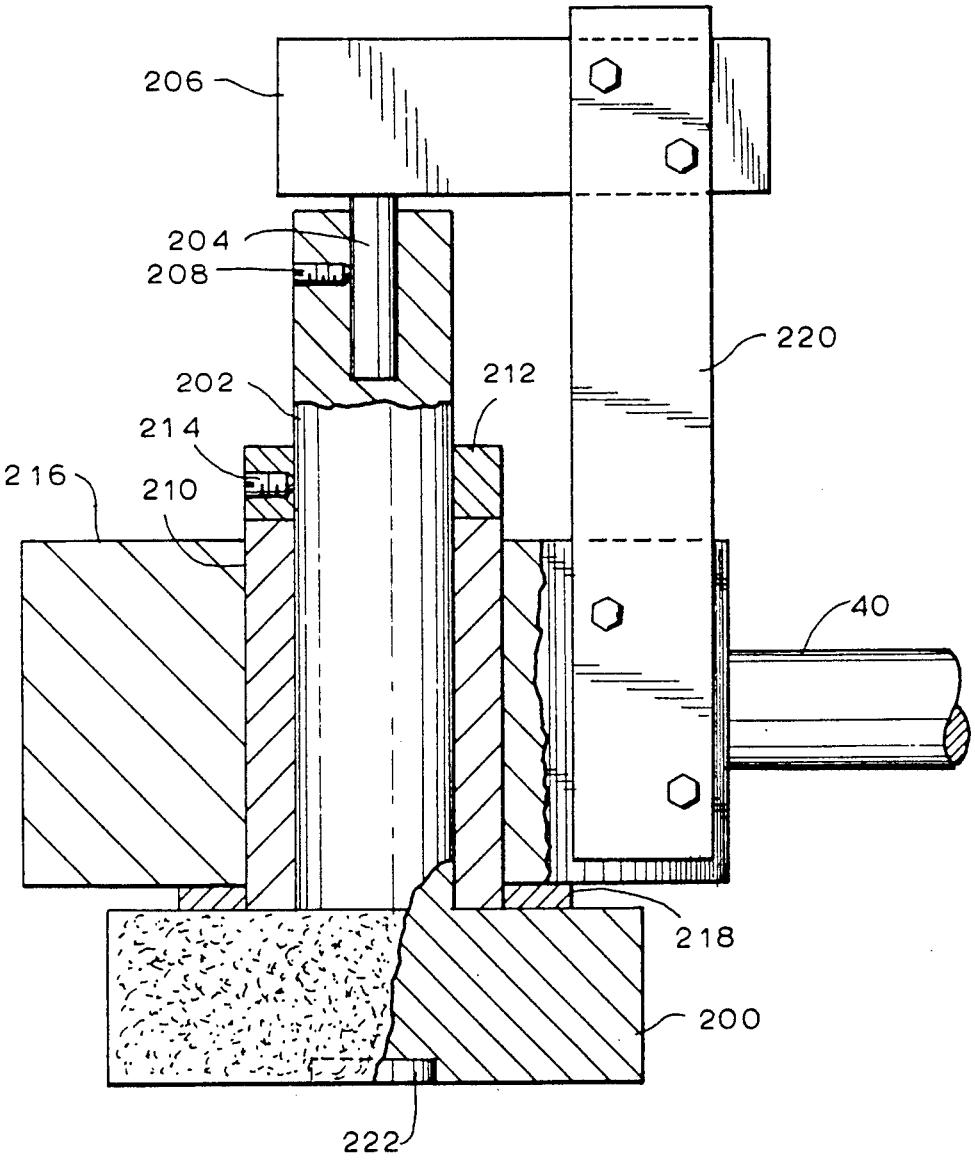
FIG. 6 is a sectional elevation view illustrating an alternative embodiment of the honing portion of the invention.

The honing stones 24, shown as having a generally rectangular configuration, may alternatively be cylindrical or of other shapes. A cylindrical stone may be advantageous in that it can be indexed or rotated about its axis to evenly distribute wear, thereby insuring that a flat surface is maintained against the surface to be honed even after extended use. Such a stone is shown in FIG. 6, and described below. A 220 grit diamond hand stone may be successfully employed for honing the hard, wear surfaces of aircraft fan blade midspans.

Each honing stone 24 is secured to a holder 48 by a pivot pin 50. The stones are accordingly freely movable, respectively, about three pairs of respective axes: those of the holder pivot pins 50, those of the shafts 40, and those of the block pivot pin 38. They will accordingly rest squarely on the flat wear surfaces of the midspans without any special alignment procedure. The rotatability of the honing stone about the axis of pin 38 allows it to move substantially vertically adjacent the midspan. Its position is thereby automatically adjusted as the wear surface is honed down. While the honing stone 24 could be mounted to a ball and socket joint to provide flexibility, the above-described arrangement is preferred as it limits movement of the stone to those axes deemed essential for proper seating and honing.

Each holder 48 is secured to the end of a shaft 52. The shaft 52 extends through a block 54 having a flat upper surface. This shaft and therefore the stone 24, may be rotated to a desired position with respect to the block 54 by loosening a lock screw 55 within the block 54. The flat upper surface supports a cylindrical weight 56 mounted to the shaft. The weight may be replaced to change the pressure applied by the honing stone 24 upon the workpiece. The shaft 40 from the L-shaped block 36 is secured to this block 54 to provide the flexible movement of the honing stone 24 described above. The longitudinal axes of each respective shaft 40 and pivot pin 50 are adjacent to each other. They are also adjacent and substantially perpendicular to the honing stone.

The upper plate 14 is mounted to a pair of tracks 58 secured to the lower mounting plate 22, and is slidable thereon. The upper plate 14 may be moved back and forth along the tracks by an oscillating mechanism which includes the motor 26, a block 60 secured to the output shaft of the motor, and a linkage assembly 62 connecting the block and the upper plate 14. The block 60 includes a slot 64. A shaft 66 having a rectangular cross section is positioned within the slot. A set screw 68 is employed to maintain the shaft 66 in a fixed position. Upon loosening the set screw, the shaft 66 may be moved along the slot 64 to increase or decrease the length of the stroke. A stroke of between one and two inches is sufficient for honing the wear surfaces of most midspans. A rate of about ninety-five strokes per minute provides sufficient honing without significant heat generation. Other rates could be employed depending upon the workpiece to be honed and the speed in which one desires to complete the honing process.

The linkage assembly 62 includes a pair of adjoining, flat shafts 70, 72. The shafts are connected to each other by a nut and bolt assembly 73 extending through a longitudinal slot 74 in one shaft 72 and a small opening in the other shaft. One 70 of these shafts is pivotably secured to the upper mounting plate 14 by a pivot assembly 76. The other shaft 72 is pivotably secured to shaft 66. The length of the linkage assembly may be adjusted by loosening the nut and bolt assembly and sliding one shaft with respect to the other, thereby changing the position of the upper mounting plate 14.

The length of time the motor 26 is operated is controlled by a timer 78. Repeatable results are accordingly obtainable for each blade which is treated.

Figure 2:
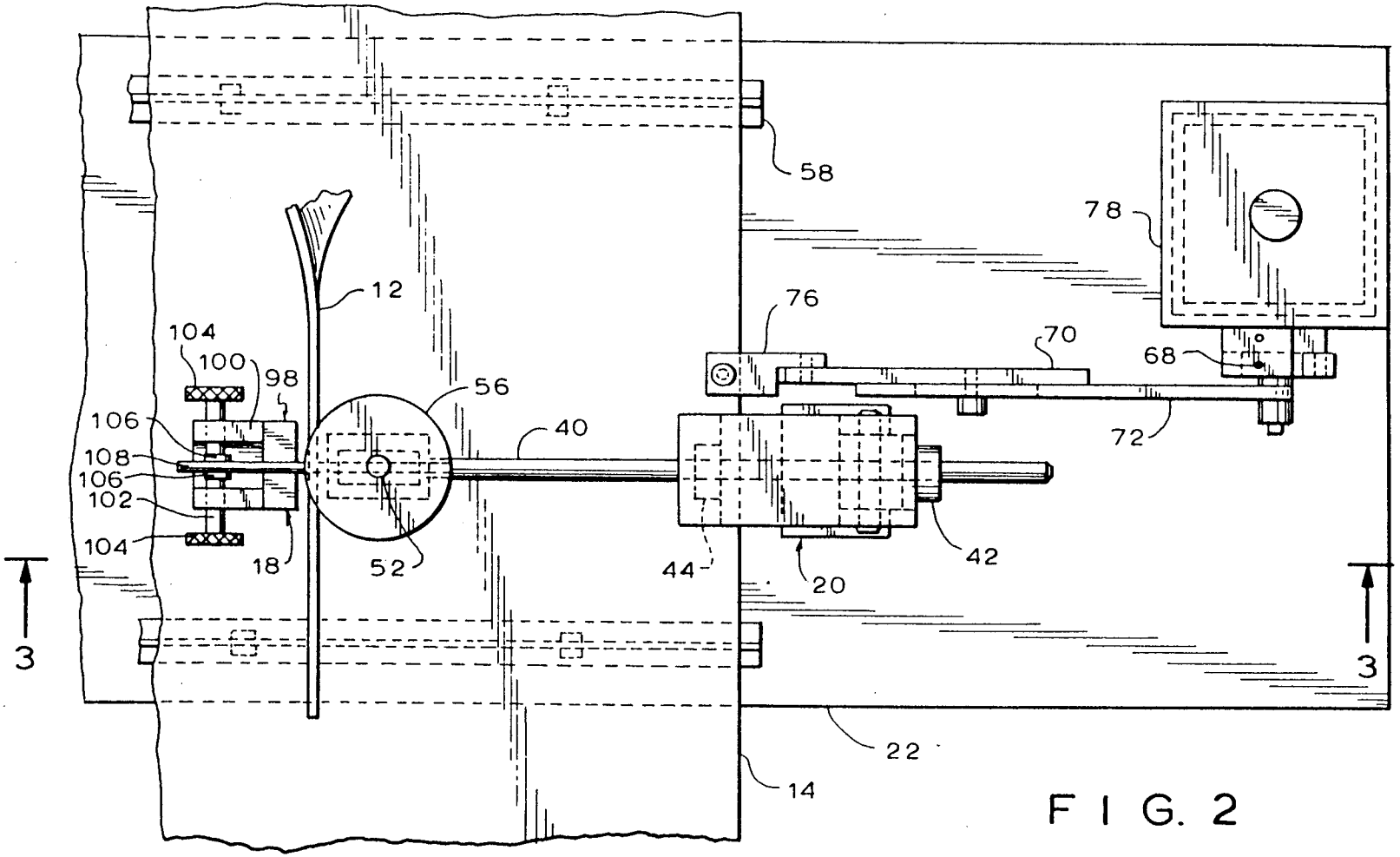
FIG. 2 is an enlarged, fragmentary top plan view thereof.
Figure 5:
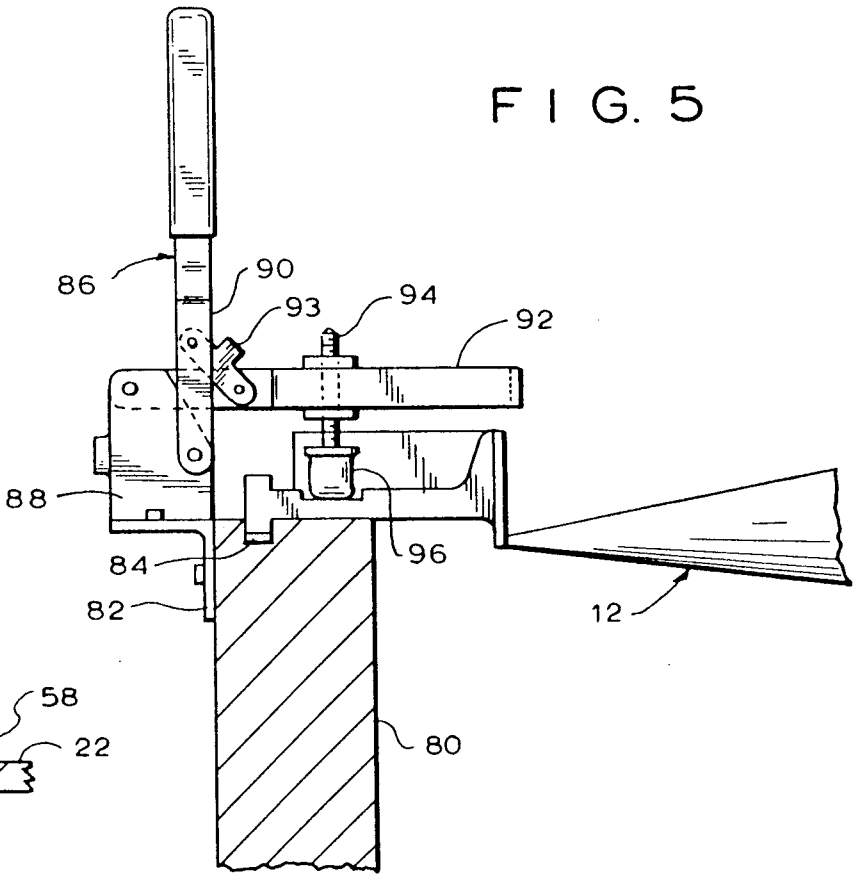
FIG. 5 is a side elevation view thereof.
Figure 4:
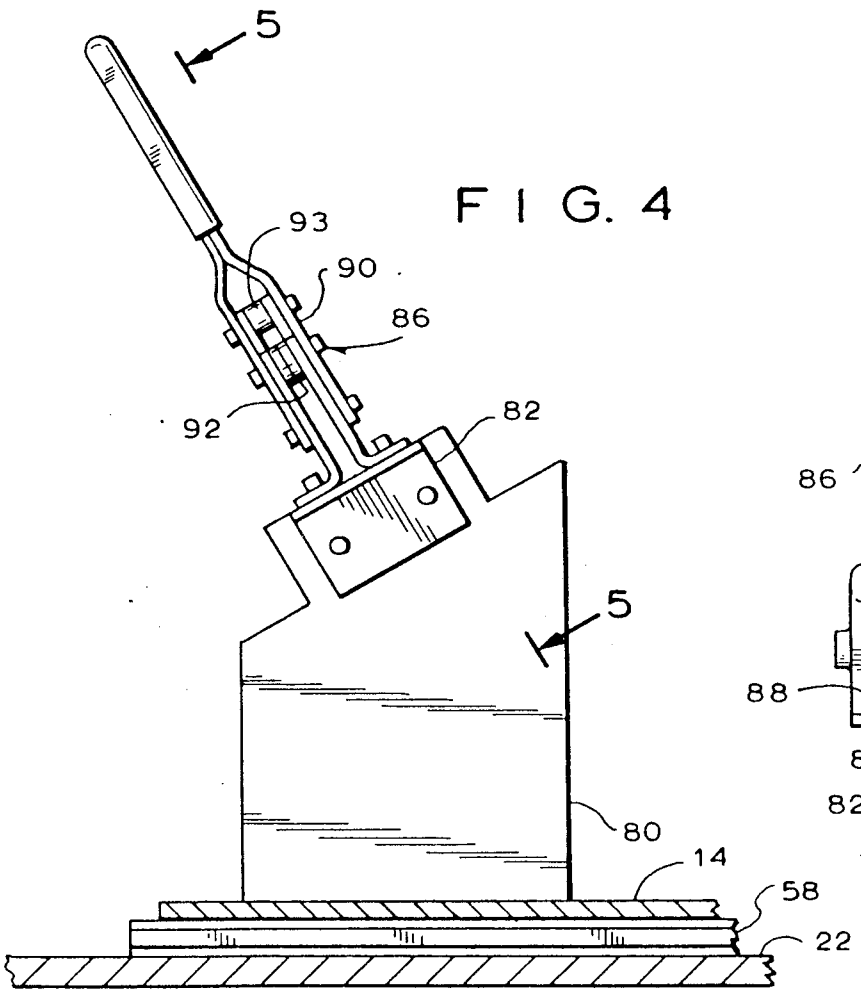
FIG. 4 is a front elevation view thereof.

The clamping assemblies 16, 18, for clamping the blades 12 are best shown in FIGS. 2 and 4–5. The clamping assembly 16 for the root portion of the blade includes a support 80 secured to the upper mounting plate 14. The support 80 includes an upper surface which is inclined with respect to the plane defined by the upper mounting plate. An elongated longitudinal groove 84 is formed within the upper surface of the support 80. The flanged end portion of the root of the blade 12 extends within this groove, as shown in FIG. 5, while flat contact is made between other portions of the root and the flat upper surface portion of the support. A toggle clamp 86 including a body portion 88, a first lever 90 pivotably secured to the body portion 88, and a second lever 92 pivotably connected to the body portion 88 and to the first lever 90 by means of a linkage assembly 93, is secured to the support 80 by a mounting bracket 82. The second lever is slotted to allow a rod 94 within the slot to be moved to a desired position and secured in place by tightening a bolt. A resilient foot 96 is secured to the end of this rod 94. The foot engages the root of the blade 12, and prevents it from moving with respect to the support 80. As shown in FIG. 3, the root of each blade is oriented on the respective supports in such a manner that the wear surfaces 112 of the midspans 108 are substantially parallel to the upper mounting plate 14.

The second set of clamping assemblies 18 are positioned upon the upper mounting plate 14. Each such assembly includes a vertically extending support 98 having a flat upper surface and three walls 100 enclosing three sides of this surface. Two of the walls are parallel and have openings extending therethrough. A lock screw 102 including a knob 104 on one end and a plastic contact piece 106 on the other end extends through each such opening. The wear surface of one of the midspans 108 of a blade 12 rests upon the flat upper surface of the support 98 when the assembly 10 is in use. The contact pieces 106 engage the sides of the midspan and prevent it from moving as the midspan on the opposite side of the airfoil is honed.

It is important that the honing stone is kept clean at all times. A drip feed 110 or other liquid supply means is accordingly provided for washing away grit and other materials. The choice of liquid depends upon the materials from which the workpiece is made, as contamination of the workpiece should be avoided.

In operation, a pair of aircraft blades are mounted to the upper mounting plate 14 and clamped in place by the respective pairs of clamping assemblies 16, 18. Each blade is oriented such that the midspan 108 on one side of the airfoil is clamped by clamping assemblies 18. The midspan on the other side thereof is oriented such that its coated wear surface 112 faces upwardly and is substantially parallel to the upper mounting plate 14, as shown in FIG. 3.

Once the two blades are clamped in place, each L-shaped block 36 is pivoted about the respective pivot pins 38 until the respective honing stones 24 rest upon the wear surfaces 112 of the respective midspans. Because each stone 24 is freely pivotable about a pivot pin 50, and each shaft 40 is freely pivotable about its longitudinal axis to a desired extent, the honing stones automatically seat themselves on the flat wear surfaces of the midspans. This is important as it insures the wear surfaces of the midspans will be honed to uniformly smooth, flat surfaces.

Upon actuation of the motor 26, the upper mounting plate 14 is caused to move back and forth along the tracks 58. The blades 12 clamped to the plate 14 oscillate with respect to the honing stones 24, the flexibility of the mountings for the stones keeping them in flat contact with the midspans at all times. The stones are continuously washed by the drip feed 110 as the upper plate 14 oscillates. Minimal heat is generated as the operation proceeds, the washing solution also serving as a coolant. This insures that the blades will not be damaged. The timer 78 controls the length of the operation.

Upon completion of the honing operation, the blades are unclamped, rotated, and re-clamped to allow the midspans on the opposite sides of their airfoils to be honed. The L-shaped blocks 36 are rotated, respectively, about pivot pins 38 to move the honing stones 24 out of the way during blade changeovers. The same procedure as described with respect to the first pair of midspans is then followed.

It will be appreciated that a motor as described above may be used for moving the honing apparatus back and forth with respect to each blade rather than moving the plate and clamped blades as described above. If necessary or desirable, a compound oscillatory stroke could be provided rather than the straight-line movement preferred for the above-described process. The principles of the invention are also applicable to the treatment of tip-shrouded fan blades having Z-notches with wear coatings.

An alternative and preferred embodiment of the invention is shown in FIG. 6. This embodiment includes a cylindrical stone 200 mounted to a cylindrical shaft 202. The stone and shaft assembly resembles a conventional grinding wheel, but is modified and mounted to be used in a honing or lapping procedure substantially as described with respect to FIGS. 1–5.

The stone and shaft assembly 200,202 is mounted to a motor shaft 204 extending from a motor 206. The motor shaft 204 is rotated at a speed of between one and twenty rpm, the preferred speed being below five revolutions per minute. A set screw 208 secures the shaft 206 to the motor shaft 204 so that the two will rotate together.

The shaft 202 is rotatable within a bronze or hardened bushing 210. A collar 212 is secured to the shaft by a set screw 214, and adjoins the top of the bushing 210. The bushing 210 is positioned within a housing 216. The housing 216 is secured to a shaft 40 as shown in FIGS. 1–3. A thrust bearing 218 may be positioned between the bottom of the housing 216 and the top of the stone 200. A pair of side plates 220 extend between and are secured to the motor 206 and housing 216. These plates 220 prevent rotation of the rotor with respect to the shaft 202 which would otherwise occur.

The assembly shown in FIG. 6 is employed in the same manner as that described with respect to FIGS. 1–5, except that the stone 200 is rotated slowly at the same time the blade 12 is subjected to oscillatory motion beneath the stone. A "cross hatch" pattern is accordingly produced on the wear surface 112 of the midspan 108, thereby providing superior flatness. The stone 200 preferably includes a recessed center portion 222 so that the outer edges thereof perform the superfinishing process. The center is preferably recessed between 1/32 and 1/16 of an inch. By constructing the stone in this manner, the formation of a hollow during the honing process is avoided.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. An apparatus for honing a wear surface of a midspan of an aircraft blade, comprising:

means for securing an aircraft blade of the type including a root, a helical airfoil extending from the root, a pair of midspans extending from opposite sides of the airfoil, and each of the midspans having a wear surface, in a fixed position;

a honing device;

means for mounting said honing device adjacent to said means for securing an aircraft blade such that said honing device is pivotably movable about first and second axes, respectively, said first and second axes being substantially perpendicular to each other, and movable in a substantially orthogonal plane whereby the position of said honing device is automatically adjustable as the wear surface of a midspan is honed down by said honing device; and means for causing relative translational movement between said honing device and said means for securing an aircraft blade.

2. An apparatus as described in claim 1 wherein said means for causing relative translational movement between said honing device and said means for securing an aircraft blade include means for oscillating said means for securing an aircraft blade in back and fourth strokes.

3. An apparatus as described in claim 1 wherein said means for securing an aircraft blade include a mounting plate, first clamping means mounted to said mounting plate for clamping the root of an aircraft blade, and second clamping means mounted to said mounting plate for clamping the midspan of an aircraft blade.

4. An apparatus for honing a wear surface of a midspan of an aircraft blade, comprising:

means for securing an aircraft blade of the type including a root, a helical airfoil extending from the root, a pair of midspans extending from opposite sides of the airfoil, and each of the midspans having a wear surface, in a fixed position, said means for securing including first clamping means for clamping the midspan of an aircraft blade and second clamping means for clamping an aircraft blade at a second location remote from the midspan;

a honing device;

means for mounting said honing device adjacent to said means for securing an aircraft blade; and means for causing relative movement between said honing device and said means for securing an aircraft blade.

5. An apparatus as described in claim 4 wherein said second clamping means include means for clamping the root of an aircraft blade.

6. An apparatus as described in claim 5 including a mounting plate, said first and second clamping means being mounted to said mounting plate.

7. An apparatus as described in claim 6 wherein said means for causing relative movement include means for oscillating said mounting plate back and forth.

8. An apparatus as described in claim 4 wherein said first clamping means include a vertically extending support, said support including first and second walls defining a slot therebetween, and means for locking a midspan in position within said slot.

9. An apparatus as described in claim 8 including a mounting plate, said first and second clamping means being mounted to said mounting plate.

10. An apparatus as described in claim 9 wherein said honing device is movably mounted to said means for mounting such that said honing device is movable along a substantially vertical axis.

11. An apparatus as described in claim 4 including means for rotating said honing device about an axis.

12. An apparatus as described in claim 11 wherein said second clamping means include means for clamping the root of an aircraft blade.

13. An apparatus as described in claim 11 wherein said second clamping means include means for supporting the root of an aircraft blade at an angle with respect to the horizontal plane.

14. A method of honing a wear surface of a midspan of an aircraft blade comprising the steps of:

providing an aircraft blade including a root, a helical airfoil extending from said root, and a pair of midspans extending from opposite sides of said airfoil, each of said midspans including a wear surface;

providing securing means for securing said aircraft blade in a fixed position, said securing means including first clamping means for clamping the midspan of an aircraft blade and second clamping means for clamping an aircraft blade at a second location remote from the midspan;

clamping one of said midspans of said aircraft blade with said first clamping means and a second portion of said aircraft blade with said second clamping means, thereby securing said aircraft blade in a fixed position with respect to said securing means;

providing a honing device and means for mounting said honing device adjacent to said securing means;

providing means for causing relative movement between said honing device and said securing means;

moving said honing device into engagement with the wear surface of one of said midspans of said aircraft blade; and actuating said means for causing relative movement, whereby said wear surface is honed by said honing device as said relative movement between said honing device and said securing means occurs.

15. A method as described in claim 14 wherein said second portion of said aircraft blade is said root.

16. A method as described in claim 14 including the step of rotating said honing device about an axis as said relative movement between said honing device and said securing means occurs.

17. A method as described in claim 16 wherein said relative movement is back and forth translational movement.

18. A method as described in claim 14 wherein said means for providing relative movement include a mounting plate, said first and second clamping means being mounted to said mounting plate, including the step of oscillating said mounting plate.

19. A method as described in claim 18 including the step of clamping said aircraft blade such that the wear surfaces of said midspans are substantially parallel to said mounting plate.

20. A method as described in claim 19 including the step of rotating said honing device about an axis as said mounting plate is oscillated.

* * * * *